United States Patent [19]

Yamada

[11] Patent Number: 4,882,968

[45] Date of Patent: Nov. 28, 1989

[54] TRILL MECHANISM FOR WIND INSTRUMENT

[76] Inventor: Masayuki Yamada, Minami 2-23, Nangodori 2-Chome, Shiroishi-ku, Sapporo-Shi, Hokkaido, Japan

[21] Appl. No.: 299,388

[22] Filed: Jan. 23, 1989

[30] Foreign Application Priority Data

Jun. 27, 1988 [JP] Japan ..... 63-156975

[51] Int. Cl.[4] ..... G10D 7/02

[52] U.S. Cl. ..... 84/384; 84/380 R

[58] Field of Search ..... 84/380 R, 382, 384, 84/385 R

[56] References Cited

U.S. PATENT DOCUMENTS

| | | | |
|---|---|---|---|
| 901,913 | 10/1908 | Julliot | 84/384 |
| 1,586,794 | 6/1926 | Gage | 84/384 |
| 4,376,403 | 3/1983 | Haedrich et al. | 84/384 |

*Primary Examiner*—L. T. Hix
*Assistant Examiner*—Brian W. Brown
*Attorney, Agent, or Firm*—Sughrue, Mion, Zinn, Macpeak & Seas

[57] ABSTRACT

A trill mechanism for a wind instrument such as a flute or a piccolo which assures production of clear sounds of a stabilized tune with a clear fundamental tone with minimized noises upon trill playing and production of a D′ (D″#) tone with a sound volume substantially equal to that of the other tones (about three times that of the D′ (D″#) tone with a conventional trill mechanism). The trill mechanism comprises a middle joint in the form of a hollow tube having a single trill tone hole bored at a particular location thereof, a trill cup mounted on the middle joint for movement from and to a closing position in which the trill cup closes the trill tone hole of the middle joint, and a spring for urging the trill cup to the closing position. The trill cup can be manually moved alternatively to a first and second open position in which the trill tone hole of the middle joint is open with a first opening or with a second opening which is greater than the first opening.

7 Claims, 4 Drawing Sheets

14
20
21
24
17
$t_{r_2}$
$t_{r_1}$
A
18
12
$d_2$
$d_1$
19
16
II
10
11
22
15
13
B

16
$11_b$
$11_a$
11
19
10
A

TRILL MECHANISM FOR WIND INSTRUMENT

BACKGROUND OF THE INVENTION

1. Field of the Invention

This invention relates to a trill mechanism for a wind instrument such as a flute or a piccolo.

2. Description of the Prior Art

Such a trill mechanism for a wind instrument as shown in FIG. 6 is already known. Referring to FIG. 6, the trill mechanism shown includes a middle joint a connected to a head joint b and having a pair of tone holes perforated therein including a D trill tone hole 1 and a D# trill hole 2. The trill mechanism further includes a D trill cup 3 and a D# trill cup 4, a D trill key $t_{r1}$ and a D# trill key $t_{r2}$ for operating the D and D# trill cups 3 and 4 to open or close the D and D# trill tone holes 1 and 2, respectively, and a pair of axial rods 5 and 6 having the cup 3 and key $t_{r1}$ and the cup 4 and key $t_{r2}$ mounted on the opposite end portions thereof, respectively.

It is not theoretically proved at present, however, that a trill mechanism for a manner of trill playing must necessarily include two tone holes as in such a trill mechanism as described above.

On the contrary, presence of such two tone holes will result in the following drawbacks. In particular, while the D"# tone should essentially be 586 Hz ideally where the A' tone is 442 Hz, the D"# tone sounds in a considerably low sound. Consequently, the tune is not stabilized, much noise is included, the fundamental tone is ambiguous and the sound becomes hoarse, resulting in low quality of sounds. Further, the D' (D"#) tone becomes smaller in volume of sound than the other tones because the flow of sound is small.

A sound D' which actually sounds upon operation of the D trill key $t_{r1}$ is a sound when the hydrodynamic energy (flow rate or speed of a breath) is low, and is thus apt to decrease at all. To the contrary, a sound D"# which actually sounds upon operation of the D# trill key $t_{r2}$ is high in hydrodynamic energy and has a frequency higher than twice that of the D' tone, and accordingly, it is apt to rise.

SUMMARY OF THE INVENTION

It is an object of the present invention to provide a trill mechanism for a wind instrument such as a flute or a piccolo which assures production of clear sounds of a stabilized tune with a clear fundamental tone with minimized noises upon trill playing.

It is another object of the present invention to provide a trill mechanism for a wind instrument such as a flute or a piccolo which assures production of a D' (D"#) tone with a sound volume substantially equal to that of the other tones (about three times that of the D' (D"#) tone with a conventional trill mechanism).

In order to attain the objects, according to the present invention, there is provided a trill mechanism for a musical instrument such as a flute or a piccolo, which comprises a middle joint in the form of a hollow tube having a single trill tone hole bored at a particular location thereof, a trill cup mounted on the middle joint for movement from and to a closing position in which the trill cup closes the trill tone hole of the middle joint, a spring for urging the trill cup to the closing position, and manually operable means for alternatively moving the trill cup to a first open position in which the trill tone hole of the middle joint is open with a first opening or to a second open position in which the trill tone hole is open with a second opening which is greater than the first opening.

With the trill mechanism, a D' tone or a D"# tone can be produced readily by manually operating the manually operable means to move the trill cup to the first or second open position. Accordingly, a stabilized tune is obtained stably comparing with a conventional trill mechanism wherein a D trill tone hole and a D# trill tone hole are provided separately from each other. Besides, noises are reduced so that the fundamental note becomes clear and a clear sound can be obtained, and a sound volume can be attained which is three times that of a conventional trill mechanism and substantially equal to that of the other notes than the D' and D"# notes.

In short, the trill mechanism according to the present invention is effective to improve the performances of a flute or a piccolo as a musical instrument including all of the tune, quality and sound volume. The trill mechanism is further effective to attain a manner of quick trill playing of the wind instrument.

Where the trill tone hole is spaced by a smaller distance from the mouth hole of the musical instrument than a location at which a D trill tone hole should naturally be bored and by a greater distance from the mouth hole than another location at which a D# trill tone hole should naturally be bored, the D' tone is stabilized in frequency and waveform in combination with the smaller opening of the trill tone hole by the trill cup while the D"# tone is also stabilized in frequency and waveform in combination with the greater opening of the trill tone hole by the trill cup.

Where the trill tone hole has a diameter of about 5.2 mm which is greater than the diameter of 4.1 mm in the case of a trill tone hole in a conventional trill mechanism, an accurate tune of a stabilized frequency and waveform can be attained further effectively.

The above and other objects, features and advantages of the present invention will become apparent from the following description and the appended claims, taken in conjunction with the accompanying drawings.

DETAILED DESCRIPTION OF THE PREFERRED EMBODIMENT

Referring to FIGS. 1 to 4, there is shown a piccolo to which a trill mechanism according to the present invention is applied. The piccolo shown includes a middle joint A removably connected at one end thereof to a head joint B and having a single trill tone hole 10 bored at a location thereof near the head joint B.

Figure 6:
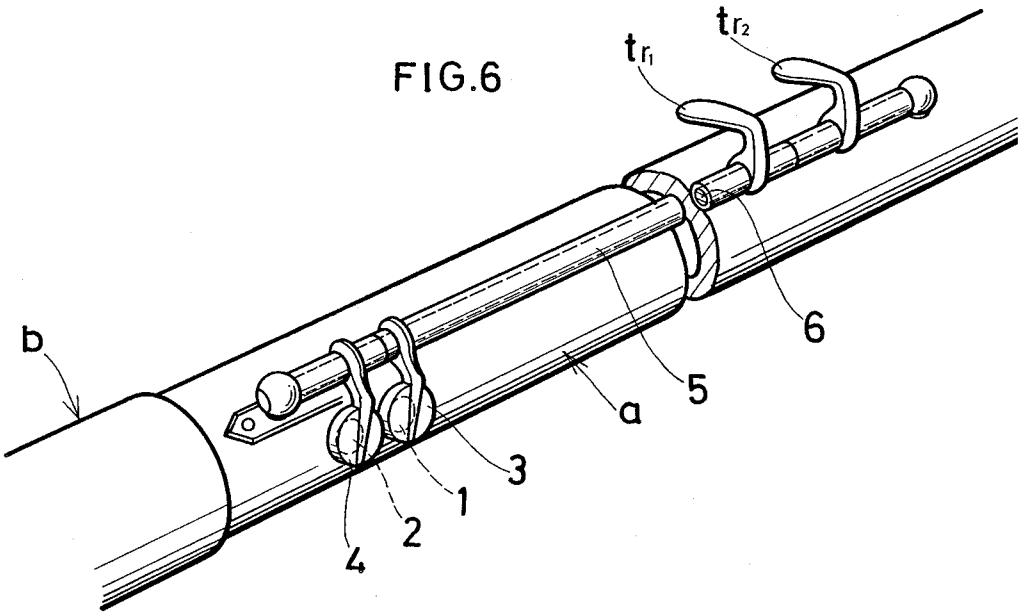
FIG. 6 is a partial perspective view, partly broken, showing a piccolo in which a conventional trill mechanism is employed.

In particular, the trill tone hole 10 is bored at a position substantially corresponding to the central position between the D trill tone hole 1 and the D# trill tone hole 2 of the trill mechanism of the piccolo described hereinabove as a conventional trill mechanism with reference to FIG. 6. The trill tone hole 10 may be bored at a position displaced by 1 to 2 mm or so from the specific position depending upon a piccolo. Accordingly, the trill tone hole 10 is spaced by a smaller distance from a mouth hole not shown of the head joint B than the D trill tone hole 1 of the conventional trill mechanism and by a greater distance from the mouth hole than the D# trill tone hole 2.

The trill tone hole 10 has a diameter of 5.2 mm with a tolerance of ±1 mm which is greater than a diameter of 4.1 mm of conventional trill tone holes such as the D and D# trill tone holes 1 and 2.

The trill tone hole 10 is adapted to be opened or closed by a trill cup 11. The trill cup 11 is of the normally closed type and has a closing position in which it closes the trill tone hole 10 as shown by solid lines in FIG. 2 and first and second positions displaced to open the trill tone hole 10 with smaller and greater openings as shown by two-dot chain lines 11*a* and long and short dash lines 11*b* in FIG. 2, respectively. At the first position 11*a* which provides the smaller opening, the trill cup 11 is spaced, for example, by 1.2 mm with a tolerance of ±5/10 mm from an outer plane of an opening of the trill tone hole 10, but at the second position 11*b* which provides the greater opening, the trill cup 11 is spaced, for example, by 2.0 mm with a tolerance of ±5/10 mm from the outer plane of the opening of the trill tone hole 10. When the trill cup 11 is positioned at the first position 11*a* for the smaller opening, the trill tone hole 10 presents the D' tone because the oscillation frequency is controlled low, but when the trill cup 11 is positioned at the second position 11*b* for the greater opening, the trill tone hole 10 presents the D"# tone because the oscillation frequency is allowed to increase.

The trill cup 11 is normally urged to the closing position by a spring which will be hereinafter described and operatively connected to a D trill key $t_{r1}$ and a D# trill key $t_{r2}$ by a mechanism which will be described below such that it may be opened to the first position 11*a* of the smaller opening by operation of the D trill key $t_{r1}$ but to the second position 11*b* of the greater opening by operation of the D# trill key $t_{r2}$.

In particular, an axial rod 12 is supported at the opposite ends thereof for rotation on and extends between a pair of support posts 13 and 14 mounted at a pair of axially spaced locations of the middle joint A. A cover tube 15 is fitted and mounted in an integral relationship on the axial rod 12 adjacent the support post 13, and a support lever 16 is mounted at one end thereof in an integral relationship on the cover tube 15. The trill cup 11 is mounted at the other end of the support lever 16. Another cover tube 17 is fitted and mounted in an integral relationship on the axial rod 12 adjacent the other support post 14, and the D# trill key $tr_2$ is mounted at one end thereof in an integral relationship on the cover tube 17.

A hollow pipe or tube 18 is fitted for rotation around the axial rod 12 between the cover tubes 15 and 17, and an engaging lever 19 is mounted in an integral relationship at an end portion of the hollow pipe 18 adjacent the cover tube 15. The engaging lever 19 is laterally bent at a mid portion thereof and has the laterally end portion thereof positioned in an opposing relationship to an inner or lower side face of the support lever 16 for the trill cup 11. The D trill key $t_{r1}$ is mounted in an integral relationship at the other end portion of the hollow pipe 18.

A spring rod 20 is secured at a base end thereof to the support post 14 and engaged at the other end thereof with a spring receiver 21 secured to the cover tube 17. The spring rod 20 thus normally exerts an urging force to turn the axial rod 12 around its longitudinal axis in the direction indicated by an arrow mark d1 in FIG. 1 or 4 to move the trill cup 11 to its closing position.

Another auxiliary spring rod 22 is secured at a base end thereof to the other support post 13 and engaged at the other end thereof with a spring receiver 23 secured to the hollow pipe 18. The auxiliary spring rod 22 thus normally exerts an urging force to turn the hollow pipe 18 around the axial rod 12 in the direction indicated by an arrow mark d2 in FIG. 1 or 4 to hold the laterally bent end of the engaging lever 19 in normal contact with the inner face of the support lever 16.

The urging force of the spring 22 is set smaller than that of the spring 20 so that the axial rod 12 may not normally be pivoted by the spring 22 against the urging force of the spring 20.

Another rod 24 is securely mounted on the middle joint A in parallel to the axial rod 12 and the hollow pipe 18 and positioned below the D and D# trill keys $t_{r1}$ and $t_{r2}$ so that it may act as a stopper for the D or D# trill key $t_{r1}$ or $t_{r2}$ when the D or D# trill key $t_{r1}$ or $t_{2r}$ is manually depressed by a player of the piccolo.

Figure 1:
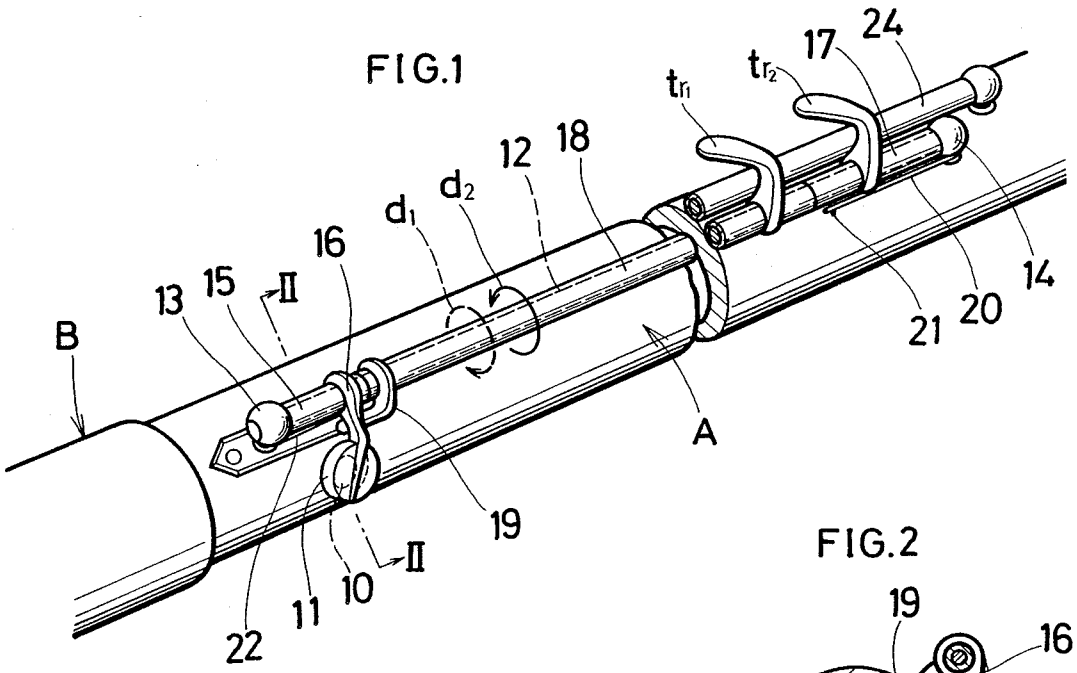
FIG. 1 is a partial perspective view, partly broken, of a piccolo to which a trill mechanism according to the present invention is applied.
Figure 2:
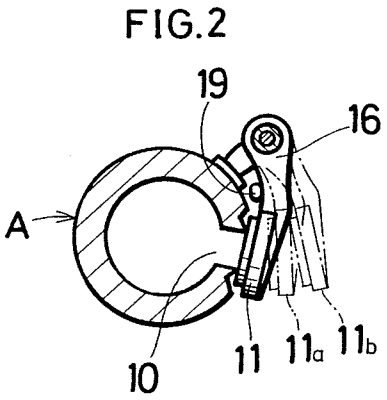
FIG. 2 is a sectional view taken along line II—II of FIG. 1.
Figure 3:
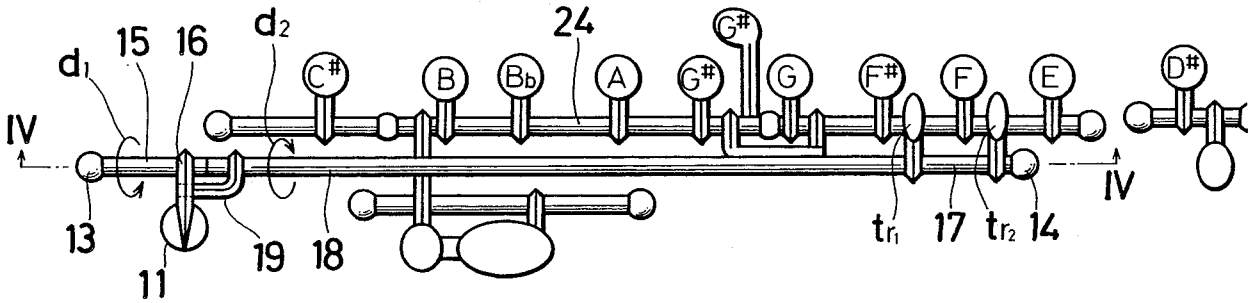
FIG. 3 is a diagrammatic representation of the trill mechanism of the piccolo shown in FIG. 1.
Figure 4:
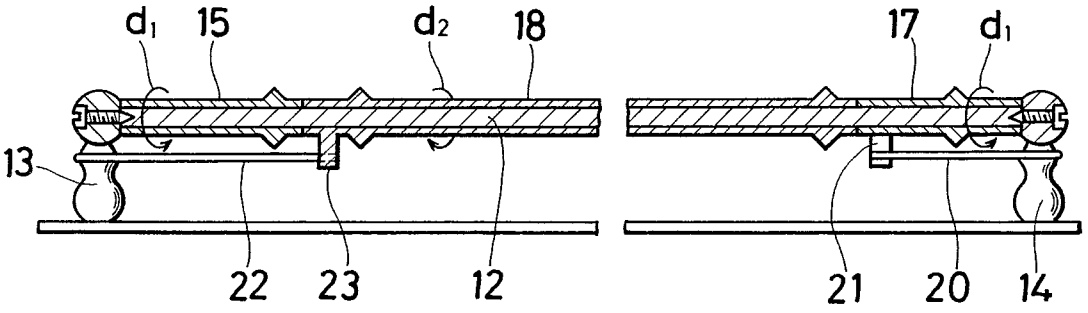
FIG. 4 is an enlarged sectional view, partly cut away, taken along line IV—IV of FIG. 3.

Now, if a player of the piccolo manually depresses the D trill key $t_{r1}$ until the latter is contacted with and stopped by the rod 24, the hollow pipe 18 is turned around the axial rod 12 so that the engaging lever 19 thereon pivots the support lever 16 together with the axial rod 12 in the direction indicated by the arrow mark d2 in FIG. 1 or 4 around the longitudinal axis of the axial rod 12 against the urging force of the spring 20 to move the trill cup 11 from the closing position shown in solid lines in FIG. 2 to the first open position shown by the two-dot chain lines in FIG. 2 in which it provides the smaller opening to the trill tone hole 10.

To the contrary, if a player depresses the D# trill key $t_{r2}$ until the latter is contacted with and stopped by the rod 24, the axial rod 12 is turned in the same direction indicated by the arrow mark d2 in FIG. 1 or 4 against the urging force of the spring 20 to move, via the support lever 16, the trill cup 11 to the second open position shown by the long and short dash lines in FIG. 2 in which it provides the greater opening to the trill tone hole 10.

In this manner, by operation of the D or D trill key $t_{r1}$ or $t_{r2}$, the aforementioned D' or D"# tone can be produced with the piccolo.

Figure 5:
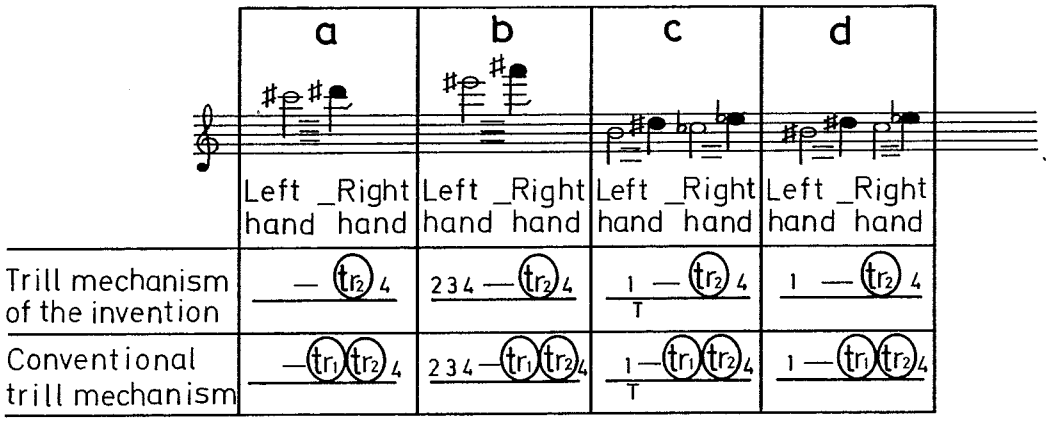
FIG. 5 is a table illustrating fingerings in a manner of trill playing with the piccolo shown in FIGS. 1 to 4 in comparison with those with a conventional trill mechanism.

Referring now to FIG. 5, there is shown a fingering table which illustrates a manner of trill playing with the piccolo in which the trill mechanism according to the present invention described above is incorporated in contrast to that with a piccolo which includes a conventional trill mechanism.

The example shown in the table exhibits manners of use of the trill keys $t_{r1}$ and $t_{r2}$ in fingerings in which fundamental tones are combined with their individual harmonics. In order to produce such tones as shown in columns a to d of the table, the two trill keys $tr_1$ and $t_{r2}$ must be manually operated at a time with such a conventional trill mechanism as shown in FIG. 6, but with the trill mechanism to which the present invention is applied, only the trill key $t_{r2}$ must be manually operated.

Thus, with the trill mechanism according to the present invention, a difficult operation to manually depress two keys at a time with a conventional trill mechanism is replaced by an easy operation of a single key. Accordingly, the trill mechanism according to the present invention can achieve quicker playing of the musical instrument and thus will assure remarkable progress and development of a manner of trill playing.

It is to be noted that, while in the embodiment described above the two D and D# trill keys $t_{r1}$ and $t_{r2}$ are operatively connected to the trill cup 11 in order to alternatively position the trill cup 11 to the two different opening positions, the trill cup 11 may otherwise be connected to a single trill key which is designed to be manually operated to two distinct positions. Further improvements in a manner of trill playing may be anticipated by the alternatively arrangement.

Having now fully described the invention, it will be apparent to one of ordinary skill in the art that many changes and modifications can be made thereto without departing from the spirit and scope of the invention as set forth herein.

What is claimed is:

1. A trill mechanism for a musical instrument such as a flute or a piccolo, comprising a middle joint in the form of a hollow tube having a single trill tone hole bored at a particular location thereof, a trill cup mounted on said middle joint for movement from and to a closing position in which said trill cup closes said trill tone hole of said middle joint, a spring for urging said trill cup to the closing position, and manually operable means for alternatively moving said trill cup to a first open position in which said trill tone hole of said middle joint is open with a first opening or to a second open position in which said trill tone hole is open with a second opening which is greater than the first opening.

2. A trill mechanism for a musical instrument as claimed in claim 1, wherein said trill tone hole is spaced by a smaller distance from said mouth hole of said musical instrument than a location at which a D trill tone hole should naturally be bored and by a greater distance from the mouth hold than another location at which a D# trill tone hole should naturally be bored.

3. A trill mechanism for a musical instrument as claimed in claim 2, wherein said trill tone hole has a diameter of 5.2 mm or so.

4. A trill mechanism for a musical instrument as claimed in claim 1, wherein said trill cup is spaced from said trill tone hole by about 1.2 mm or 2.0 mm when said trill cup is at the first or second open position, respectively.

5. A trill mechanism for a musical instrument as claimed in claim 1, wherein said manually operable means includes a single trill key manually movable to two distinct positions corresponding to the first and second open positions of said trill cup.

6. A trill mechanism for a musical instrument as claimed in claim 1, wherein said manually operable means includes first and second manually operable trill keys for moving said trill cup to the first and second open positions, respectively.

7. A trill mechanism for a musical instrument as claimed in claim 6, wherein said manually operable means includes a lever having said trill cup mounted thereon and connected to be moved by said second manually operable trill key, and an engaging member connected to be moved by said first manually operable trill key to move said trill cup to the first position through engagement thereof with the lever.

* * * * *